US005972043A

United States Patent [19]

Galvan et al.

[11] Patent Number: 5,972,043

[45] Date of Patent: Oct. 26, 1999

[54] METHODS FOR MIXING AND APPLYING HAIR COLORING COMPOUNDS, AND HAIR COLORING DEVICES AND KITS WHICH COMPRISE A BRUSH AND AN ENCLOSED MIXING BOWL

[76] Inventors: Tim Galvan; Hortencia Galvan, both of P.O. Box 265, St. John, Ind. 46321

[21] Appl. No.: 09/042,868

[22] Filed: Mar. 17, 1998

[51] Int. Cl.[6] ..... A61K 7/13

[52] U.S. Cl. ..... 8/405; 132/208; 132/313; 366/206; 366/244

[58] Field of Search ..... 8/405, 406; 15/22.2; 132/313, 208; 206/15.3; 366/206, 244, 276; 401/268; D4/132; D28/7, 20; 424/70.6, 70.7

[56] References Cited

U.S. PATENT DOCUMENTS

| | | | |
|---|---|---|---|
| D. 279,729 | 7/1985 | Polanish | D4/135 |
| D. 335,085 | 4/1993 | Wacker | D9/504 |
| D. 371,003 | 6/1996 | Wolfenden | D4/135 |
| 3,972,512 | 8/1976 | Grise et al. | 259/102 |
| 4,845,796 | 7/1989 | Mosley | 15/23 |
| 5,209,565 | 5/1993 | Goncalves | 366/130 |
| 5,226,744 | 7/1993 | Kemmerer | 132/218 |
| 5,403,357 | 4/1995 | Tsujino | 8/405 |
| 5,417,493 | 5/1995 | Ericson | 366/343 |
| 5,450,646 | 9/1995 | McHugh et al. | 15/22.1 |
| 5,540,363 | 7/1996 | Wilson | 224/148.7 |
| 5,551,454 | 9/1996 | Goncalves | 132/208 |
| 5,554,197 | 9/1996 | Assini et al. | 8/406 |
| 5,595,198 | 1/1997 | Kemmerer | 132/218 |
| 5,733,344 | 3/1998 | Shiraishi et al. | 8/405 |
| 5,772,015 | 6/1998 | Musiel et al. | 206/15.3 |
| 5,810,497 | 9/1998 | Bachmann et al. | 132/313 |
| 5,826,741 | 10/1998 | Dumler et al. | 132/313 |

*Primary Examiner*—Caroline D. Liott
*Attorney, Agent, or Firm*—Halvorson & Venable, P.C.

[57] ABSTRACT

A device that is useful for the mixing and application of hair coloring products comprises a mixing and application brush with a handle that is attached to a brush portion. The handle is adapted to be received by and work with a rotating hand tool. The brush portion includes a brush base that is generally spatulate in shape and includes at least one mixing aperture. Bristles are also included for applying the mixture to a client's hair. Moreover, a two-piece mixing bowl, having a lower portion and an upper portion is provide. The upper portion of the mixing bowl has an aperture that is designed to receive the handle of the brush and allow the brush to be rotated within the bowl by the hand tool. The brush and mixing bowl may be provided in an convenient kit form and a method for using the same is provided.

9 Claims, 3 Drawing Sheets

METHODS FOR MIXING AND APPLYING HAIR COLORING COMPOUNDS, AND HAIR COLORING DEVICES AND KITS WHICH COMPRISE A BRUSH AND AN ENCLOSED MIXING BOWL

FIELD OF THE INVENTION

The present invention relates to the field of dyes and coloration. More particularly, the present invention relates to a rotating applicator brush that both mixes and applies coloring materials, such as dyes.

BACKGROUND

Hair coloration is often a difficult, messy and complex procedure even for hair care professionals. There are numerous products in the hair color industry available to the hair care professional that help tint a person's hair. These include pigmented shampoos, weekly rinses, semi-permanent hair colors, permanent or peroxide hair colors and deposit only hair colors. Many of these products, especially the longer lasting hair colors, require the mixing of chemical components. Thus, hair care professionals have a need to consistently and repeatably blend and apply the hair coloration products.

As an example, in deposit only, or semi permanent hair colors, the hair color utilizes oxidative type dyes that require the addition of a catalyst. When first mixed, the chemical reaction between the components is most active. As time elapses and the formula is applied to the hair the peroxide and ammonia begin to dissipate, thereby reducing the immediate effectiveness. Since the life span of the hair dyes quickly decays with elapsed time, it would be useful to have a device that allows one to apply the hair coloration to the hair as soon after mixture as possible.

Another problem faced by hair care professionals is that a plurality of dyes may be mixed to achieve the desired color. If the one of the dyes is not completely mixed within the other dyes, then, upon activation, inhomogeneity or pockets of color may occur. This inhomogeneity in coloration is unwanted by both the client and the professional. Moreover, it is possible that if poorly mixed, one dye may be activated to a greater degree that of other dyes. Since the useful life span of a dye, once activated, is relatively short, disparate activation times can also lead to incongruous results. Therefore, it would be useful to have a device that would quickly and efficiently mix the chemical components.

Therefore there is a current and continuing need for devices that aid in the complete mixing and application of chemical hair coloration compounds. The present inventors have addressed these and other needs, in particular, the problems of complete and repeatable mixing of components followed by immediate application of the resultant mixture. The present invention provides a solution enables even the unskilled to repeatedly prepare and apply well-mixed dye formulations, without mess or inconvenience.

SUMMARY OF THE INVENTION

It is an object of the present invention to provide a device that is useful for the mixing and application of hair coloring products.

It is another object of the present invention to provide a brush that is used to both mix chemical compounds and to apply the resultant formula onto a client's hair.

It is a further object of the present invention to provide a brush that has a handle attached to a brush portion, the handle being adapted at one end to be received by and to work with a rotating hand tool. The brush portion is adapted to mix chemical components by having a generally spatulate shaped base portion with at least one mixing aperture and attached application bristles.

It is yet another object of the present invention to provide a kit for the mixing and application of chemical hair coloring, the kit containing a combination mixing and application brush, an encloseable, two-piece mixing bowl, and a rotating hand tool.

It is still yet another object of the present invention to provide a mixing bowl for use with the mixing and application brush. The mixing bowl having two pieces, a lower portion and an upper portion with an aperture therein. The upper portion being adapted to snuggly fit onto the lower portion and the aperture adapted to receive a first end of the brush handle and allow rotation movement of the brush within the mixing bowl.

It is yet a further object of the present invention to provide a method for using the above elements to mix and apply chemical hair coloring component to a client's hair.

DESCRIPTION OF THE DRAWINGS

The novel features that are considered characteristic of the invention are set forth with particularity in the appended claims. The invention itself, however, both as to its structure and its operation together with the additional object and advantages thereof will best be understood from the following description of the preferred embodiment of the present invention when read in conjunction with the accompanying drawings wherein:

DESCRIPTION THE PREFERRED EMBODIMENTS

Figure 1:
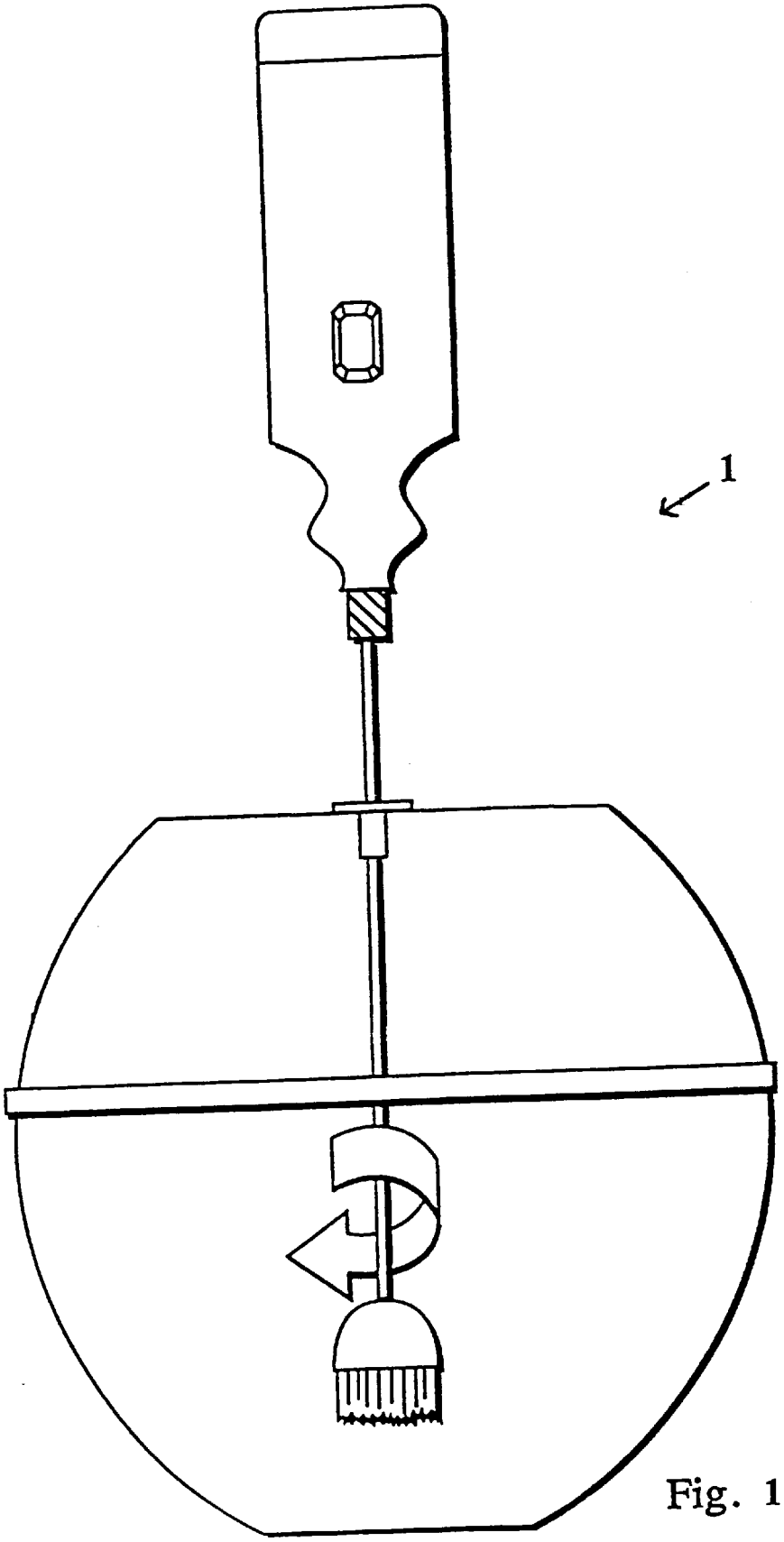
FIG. 1 illustrates the device of the present invention.
Figure 2:
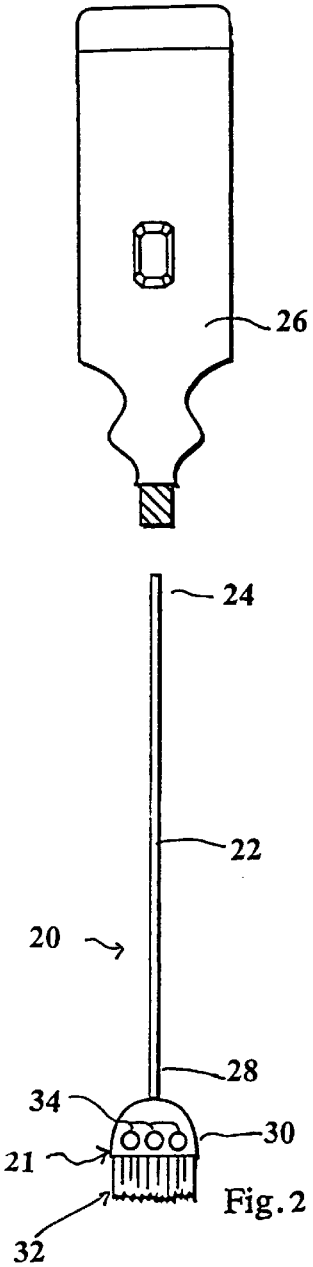
FIG. 2 is the mixing brush of the present invention mounted in a motorized rotation tool.
Figure 4:
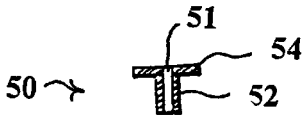
FIG. 4 is a cutaway view of the sealing grommet of the present invention.
Figure 3:
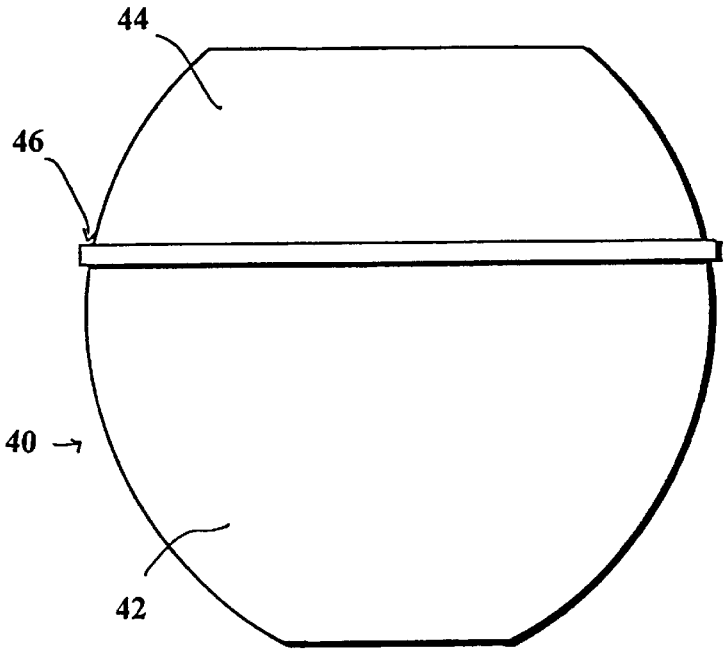
FIG. 3 is the two-part bowl of the present invention (in an assembled state)
Figure 5:
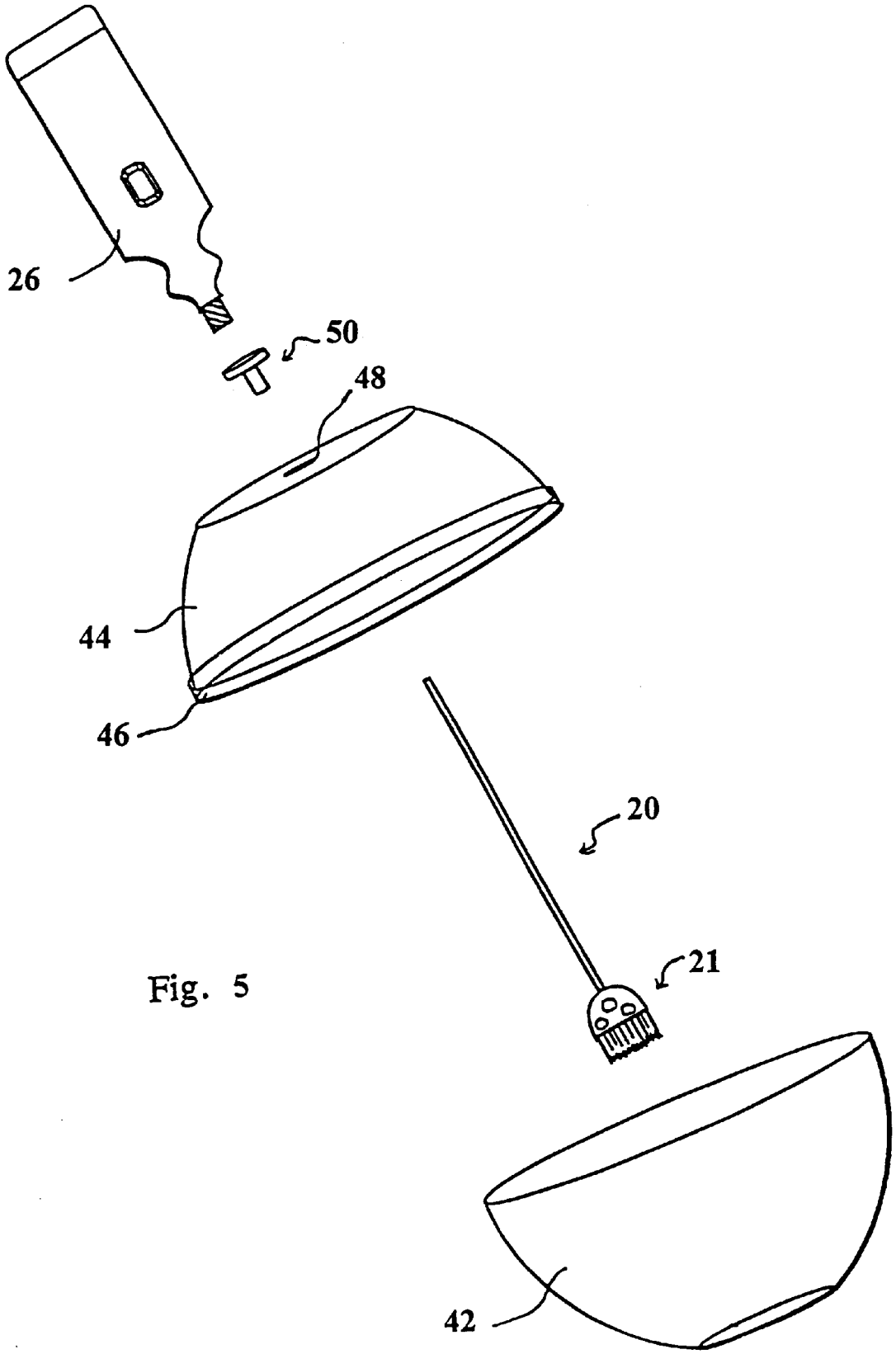
FIG. 5 is an exploded view illustrating how the components of the present invention are positioned prior to assembly.

The present invention is a device useful for both the mixing of hair coloring components and the application of the then mixed coloring compounds. Additionally, the present invention is useful in extending the lifetime of activated hair coloring, or dyes, by reducing the loss of volatile compounds. Furthermore, the present invention helps ensure the complete mixture of all hair-coloring components desired to be blended, thereby reducing any pockets of unblended color.

The device of the present invention, generally referred to as 1, is a brush 20 adapted to mix and apply to hair, hair coloring compounds. The brush 20 has a handle 22 that is adapted at a first end 24 to be received within a motorized rotational tool 26. A second end 28 of the handle 22 is attached to a brush portion 21 having a brush base 30 with further attached brush bristles 32. The handle 22 is preferred to be long and generally cylindrical. Alternatively, an elongated elliptical shape is also effective. The first end 24 may be chucked or otherwise adapted as is well known in the art to be received by the rotating tool 26.

The brush portion 21 is generally spatulate in shape. Preferably, the brush base 30 is formed into a spatulate shape to facilitate the mixing of hair coloring components. In preferred embodiments, the brush base 30 includes additional features such as at least one flow or mixing apertures 34 adapted to allow a portion of the coloring mixture to pass through the brush base 30 thereby creating an effective mixing turbulence in the mixing process when the brush 22, and specifically the brush base 30, is rotated within the hair coloring components. These apertures 34 are illustrated in the drawings as circular apertures, but may be formed of other shapes and forms to enhance the mixing capabilities of the brush.

The brush bristles 32 according to the present invention are well know in the art and may comprise a variety of characteristics, such as stiffness, length, thickness and the like. Generally, the bristles 32 are selected according to the type and nature of hair care provided.

The rotational tool 26 is furthermore well known in the art as an electrically operated hand tool in which a motor and rotating shaft is housed in the handle of the tool 26. The shaft contains a chuck that is adapted to receive the first end 24 of the brush 20. Preferably, the tool 26 is battery operated, and rechargeable, to provide for the greatest flexibility in movement and use.

The present invention also may use an enclosed mixing bowl 40 in combination with the brush 20. The mixing bowl 40 according to the present invention is a two-piece assembly with a lower portion 42 and an upper portion 44. Both the lower and upper portions, 42 and 44, are generally concave, but in a preferred embodiment, have flattened vertices. The upper portion 44 further includes a fitting lip 46 that allows a close, snug fit between the two portions. Finally, the upper portion 44 includes a handle receiving aperture 48 that is adapted to receive the first end 24 of the brush 20 therethrough.

In order to assist in the proper mixing of the product within the mixing bowl 40, a grommet 50 is included. The grommet 50 has a handle receiving channel 51 that closely receives the brush handle 22, but permits rotation about the handle 22. A central portion 52 fits within the aperture 48 to substantially fill any excess space. A flanged top cap 54 is attached to the central portion 52 to snuggly fit over the aperture 48 and on top of the upper portion 44 to prevent the grommet 50 from falling within the mixing bowl 40 and to further prevent the escape of contained chemicals. Alternately, the grommet 50 may be removed to allow peroxide and/or ammonia to dissipate during the chemical action of activation of the dyes.

Thus, in assembly, the first end 24 of the mixing brush handle 22 is directed through the handle aperture 48 located in a top location of the upper portion 44. The first end 24 is then directed through the handle channel 51 of the grommet 50. The grommet 50, with the received brush handle 22 contained therein, is then fit into the aperture 48, with the central portion 52 being received within the aperture 48 and the cap portion 54 fitting on top of the aperture 48. The rotating tool 26 is then removably attached to the distal or terminal part of the first end 24 and secured such that the brush 20 is capable of being rotationally driven by the tool 26.

Chemical coloring components are placed within the lower portion 42 of the mixing bowl 40, and the upper portion 44 is fit, snuggly by the lip 46 onto the lower portion 42. The mixing brush 20 is then rotationally driven by the tool 26 with sufficient angular velocity to ensure quick and substantially complete mixing of the coloring components.

The tool 26 may then be detached from the brush 20 and the brush 20 removed from the grommet 50 and aperture 48 to allow it to be used to apply the mixed hair color to a client's hair. The upper portion 44 of the mixing bowl 40 may be replaced to reduce the loss of the more volatile activation components, thereby extending the life span of the activated dye or color.

While these descriptions directly describe the above embodiments, it is understood that those skilled in the art may conceive modifications and/or variations to the specific embodiments shown and described herein. Any such modifications or variations which fall within the purview of this description are intended to be included therein as well. It is understood that the description herein is intended to be illustrative only and is not intended to be limitative. Rather, the scope of the invention described herein is limited only by the claims appended hereto.

What is claimed is:

1. A device for mixing hair coloring compounds, comprising; a handle attached to a brush portion, the brush portion further comprising a brush base and bristles, a mixing bowl for mixing said hair coloring compounds, said mixing bowl further comprising a lower portion which contains said hair coloring compounds and an upper portion that is adapted to fit snuggly onto the lower portion, further a first end of said handle is received through an aperture located in said upper portion, said aperture being adapted to allow for rotation of said handle and said brush portion within said upper portion and lower portion, whereby when said brush portion is placed within the hair coloring compounds and rotated, a mixing action is created by said brush base in said mixing bowl.

2. The device as in claim 1 wherein the brush base further includes at least one aperture, whereby said hair coloring compounds are capable of flowing through the aperture when the brush is rotated.

3. The device as in claim 2 wherein the brush base is spatulate in shape.

4. The device as in claim 1 wherein the brush handle is rotated by a motorized tool, the first end of the brush handle being adapted to be removably received by the motorized tool.

5. A kit for the mixing of hair coloring compounds comprise;

a) a brush with a handle attached to a brush portion;

b) a mixing bowl for said hair coloring compounds comprising a lower portion that contains hair coloring compounds, and an upper portion, the upper portion adapted to fit snuggly onto the lower portion and further having an aperture designed to receive a first end of the handle of the brush;

whereby the brush is both capable of, rotating within said mixing bowl to mix said hair coloring compounds that are placed within the mixing bowl, and applying the mixed hair coloring compounds to a clients hair.

6. The kit of claim 5 wherein the brush portion further is spatulate in shape and includes at least one aperture, the at least one aperture adapted to allow flow through of said hair coloring compounds.

7. The kit of claim 6 wherein the mixing bowl fuither includes a lip that is adapted to fit onto the lower portion of the mixing bowl, whereby the lip ensures a snug, removable fit.

8. The kit of claim 7 further including a grommet that is adapted to fit within the aperture in the upper portion of the mixing bowl, the grommet further including a central portion adapted to fit within the aperture and a top cap attached to the central portion and designed to fit over the aperture, further there is a handle receiving channel that extends longitudinally through the grommet and is adapted to receive the handle of the brush, yet allow free rotation of the brush.

9. A method for mixing and applying hair coloring compounds comprising the following steps:

a) providing a brush with a handle attached to a spatulate shaped brush portion;

b) providing a mixing bowl with a lower portion and an upper portion, the upper portion having an aperture therein;

c) directing a first end of the handle of the brush through the aperture of the upper portion of the mixing bowl, resulting in the brush portion of the brush occupying space within the mixing bowl;

d) attaching a motorized rotating hand tool onto the first end of the brush handle;

e) placing hair coloring components within the lower portion of the mixing bowl;

f) fitting snuggly the upper portion of the mixing bowl onto the lower portion of the mixing bowl;

g) rotating the brush, with the hand tool, thereby mixing the contained hair coloring components;

h) removing the hand tool from the handle of the brush;

i) disassembling the mixing bowl;

j) removing the brush from the upper portion and brushing the mixed components onto a client's hair.

* * * * *

UNITED STATES PATENT AND TRADEMARK OFFICE

CERTIFICATE OF CORRECTION

PATENT NO. : 5,972,043
DATED : Oct. 26, 1999
INVENTOR(S) : Tim Galvan

It is certified that error appears in the above-identified patent and that said Letters Patent is hereby corrected as shown below:

In the Abstract, line 2 of the Patent Abstract, change "comprises" to -comprising-.
In the Abstract, line 9 of the Patent Abstract, change "provide" to -provided-.
In Claim 5, column 4, line 42 of the Patent, change "comprise" to -comprising-.

Signed and Sealed this

First Day of August, 2000

*Attest:*

*Attesting Officer*

Q. TODD DICKINSON

*Director of Patents and Trademarks*